United States Patent [19]

Cho et al.

[11] Patent Number: 4,844,750

[45] Date of Patent: Jul. 4, 1989

[54] ALUMINUM-LITHIUM ALLOYS

[75] Inventors: Chul Won Cho, Monroeville; Ralph R. Sawtell, Pittsburgh, both of Pa.

[73] Assignee: Aluminum Company of America, Pittsburgh, Pa.

[21] Appl. No.: 793,260

[22] Filed: Oct. 31, 1985

Related U.S. Application Data

[63] Continuation-in-part of Ser. No. 594,344, Mar. 29, 1984.

[51] Int. Cl.[4] ..... C22F 1/04

[52] U.S. Cl. ..... 148/12.7 A; 148/415; 148/416; 148/417; 148/437; 148/438; 148/439; 148/440

[58] Field of Search ..... 148/12.7 A, 2, 415–418, 148/437–440

[56] References Cited

U.S. PATENT DOCUMENTS

| | | | |
|---|---|---|---|
| 1,620,081 | 3/1927 | Czochralski et al. . | |
| 1,620,082 | 3/1927 | Czochralski . | |
| 2,381,219 | 8/1945 | LeBaron | 75/139 |
| 2,915,390 | 12/1959 | Criner | 75/141 |
| 2,915,391 | 12/1959 | Criner | 75/142 |
| 4,094,705 | 6/1978 | Sperry et al. . | |
| 4,409,038 | 10/1983 | Weber . | |

FOREIGN PATENT DOCUMENTS

| | | |
|---|---|---|
| 90583 | 5/1983 | European Pat. Off. . |
| 1927500 | 2/1971 | Fed. Rep. of Germany . |
| 1148719 | 6/1957 | France . |
| 707373 | 2/1971 | U.S.S.R. . |
| 1172735 | 12/1969 | United Kingdom . |
| 2115836 | 9/1983 | United Kingdom . |
| 3401391 | 4/1984 | World Int. Prop. O. . |

OTHER PUBLICATIONS

"Advanced Aluminum Metallic Materials and Processes for Application to Naval Aircraft Structures" by W. T. Highberger et al., 12th National SAMPE Technical Conference, Oct. 7–9, 1980.

"Alloying Additions and Property Modification in Al–Li—X Systems" by F. W. Gayle, Int'l Al–Li Conference, Stone Mountain, Ga., May 19–21, 1980.

"Heat Treatment, Microstructure and Mechanical Property Correlations in Al–Li–Cu and Al–Li–Mg P/M Alloys" by G. Chanani et al., Society/AIME, Dallas, Tex., Feb. 17–18, 1982.

"Age Hardening Behavior of Al–Li–(Cu)–(Mg)–Zr P/M Alloys" by D. J. Chellman et al., Proceedings of 1982 Nat'l P/M Conf.–P/M Products and Properties Session, Montreal, Canada, May 1982.

"Precipitation in Al–Li–Cu Alloys" by J. E. O'Neal et al., 39th Annual EMSA Meeting, Atlanta, Ga., Aug. 10–14, 1981.

"HVEM In Situ Deformation of Al–Li–X Alloys" by R. E. Crooks et al., Scripta METALLURGICA, vol. 17, pp. 643–647, 1983.

"Developments in Structures and Manufacturing Techniques" by C. J. Peel et al., Aeronautical Journal, Sep. 1981.

"Aluminum–Lithium Alloys: New Materials for Tomorrow's Technology" by T. H. Sanders, Jr. et al., Foote Prints, vol. 44, No. 1, 1981.

"The Mechanical Properties of Aluminum-Lithium Alloy" by M. Y. Drtis et al., Splavy Tsvetnykh Metalloy, 1972, pp. 187–192.

"Factors Influencing Fracture Toughness and Other Properties of Aluminum-Lithium Alloys" by T. H. Sanders et al., Naval Air Dev. Center Contract No. N62269–76–C–0271 for Naval Air Systems Command.

"Aluminum-Lithium Alloys II", edited by E. A. Starke, Jr. and T. H. Sanders, Jr. on Feb. 1984.

*Primary Examiner*—R. Dean

*Attorney, Agent, or Firm*—Andrew Alexander

[57] ABSTRACT

Disclosed is a method of making lithium containing aluminum base alloy products having improved properties in the short transverse direction. The method comprises the steps of providing a body of a lithium containing aluminum base alloy and heating the body to a temperature for initial hot working but at a temperature sufficiently low that a substantial amount of grain boundary precipitate is not dissolved. The method further includes hot working the heated body to provide an intermediate product, recrystallizing the intermediate product and then hot working the recrystallized product to a final shaped product. The final shaped product is solution heat treated, quenched and aged to provide a non-recrystallized final product having improved levels of short transverse properties.

38 Claims, 7 Drawing Sheets

R-CURVE TOUGHNESS VS. YIELD STRENGTH

R-CURVE TOUGHNESS VS. YIELD STRENGTH

R-CURVE TOUGHNESS VS. YIELD STRENGTH

EFFECT OF STRETCH ON TEAR/YIELD RATIO

EFFECT OF STRETCH ON TEAR/YIELD RATIO

EFFECT OF STRETCH ON LONG-TRANSVERSE TOUGHNESS

TEAR STRENGTH - YIELD STRENGTH RATIO VS YIELD STRENGTH FOR 2024

Lot No. 400-431
1.75" Thick $Al_2O_9O$ plate
Recrystallized at 3.5"
Hot rolled to 1.75"
Magnification 100x at T/2 Area Lot No. 400-421
1.75" $Al_2O_9O$ Plate
Preforged to 10"
Hot Rolled to 1.75"
Magnification 100x at T/2 Area

YIELD STRESS VS. SPECIMEN ORIENTATION 1.0" Thick Plate
Al-2Li-3Cu-0.11 Zr
16 Hr/1010°F T/2 100x Longitudinal T/2 50x

ALUMINUM-LITHIUM ALLOYS

CROSS REFERENCE TO RELATED APPLICATIONS

This application is a continuation-in-part of U.S. Ser. No. 594,344, filed Mar. 29, 1984.

BACKGROUND OF THE INVENTION

This invention relates to aluminum base alloy products, and more particularly, it relates to improved lithium containing aluminum base alloy products and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

However, in the past, aluminum-lithium alloys have exhibited poor transverse ductility. That is, aluminum-lithium alloys have exhibited quite low elongation and toughness properties which has been a serious drawback in their commercialization.

It will be appreciated that both high strength and high fracture toughness appear to the quite difficult to obtain when viewed in light of conventional alloys such as AA (Aluminum Association) 2024-T3X and 7050-TX normally used in aircraft applications. For example, a paper by J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings, Thus, it will be appreciated that obtaining qualities such as high strength at little or no sacrifice in toughness, or where toughness can be controlled as the strength is increased would result in a remarkably unique aluminum-lithium alloy product.

The present invention solves problems which limited the use of these alloys and provides an improved lithium containing aluminum base alloy product which can be processed to improve ductility characteristics while retaining high strength properties.

SUMMARY OF THE INVENTION

An object of this invention is to provide an aluminum lithium alloy and thermomechanical processing practice which greatly improves the short transverse properties of such alloy.

A further object of this invention is to provide a thermomechanical process which greatly improves the short transverse properties of aluminum-lithium alloys without detrimentally affecting properties in the other directions.

A principal object of this invention is to provide an improved lithium containing aluminum base alloy product.

Another object of this invention is to provide an improved aluminum-lithium alloy wrought product having improved strength and toughness characteristics.

Yet another object of this invention is to provide an aluminum-lithium alloy product capable of being worked after solution heat treating to improve strength properties without substantially impairing its fracture toughness.

And yet another object of this invention includes a method of providing a wrought aluminum-lithium alloy product and working the product after solution heat treating to increase strength properties without substantially impairing its fracture toughness.

And yet a further object of this invention is to provide a method of increasing the strength of a wrought aluminum-lithium alloy product after solution heat treating without substantially decreasing fracture toughness.

These and other objects will become apparent from the specification, drawings and claims appended hereto.

In accordance with these objects, disclosed is a method of making lithium containing aluminum base alloy products having improved properties particularly in the short transverse direction. The product comprises 0.5 to 4.0 wt. % Li, 0 to 5.0 wt. % Mg, up to 5.0 wt. % Cu, 0.03 to 0.15 wt. % Zr, 0 to 2.0 wt. % Mn, 0 to 7.0 wt. % Zn, 0.5 wt. % max. Fe, 0.5 wt. % max. Si, the balance aluminum and incidental impurities. The method of making the product comprising the steps of providing a body of a lithium containing aluminum base alloy and heating the body to a temperature for initial hot working but at a temperature sufficiently low such that a substantial amount of grain boundary precipitate is not dissolved. Additionally, the method includes low temperature hot working the heated body to provide an intermediate product, recrystallizing said intermediate product, and hot working the recrystallized product to a final shaped product. The final shaped product is solution heat treated, quenched and aged to provide a non-recrystallized product having improved levels of short transverse properties. Prior to the aging step, the product is capable of having imparted thereto a working effect equivalent to stretching an amount greater than 3% so that the product has combinations of improved strength and fracture toughness after aging. The degree of working as by stretching, for example, is greater than that normally used for relief of residual internal quenching stresses.

DETAILED DESCRIPTION OF THE PREFERRED EMBODIMENTS

Figure 1:
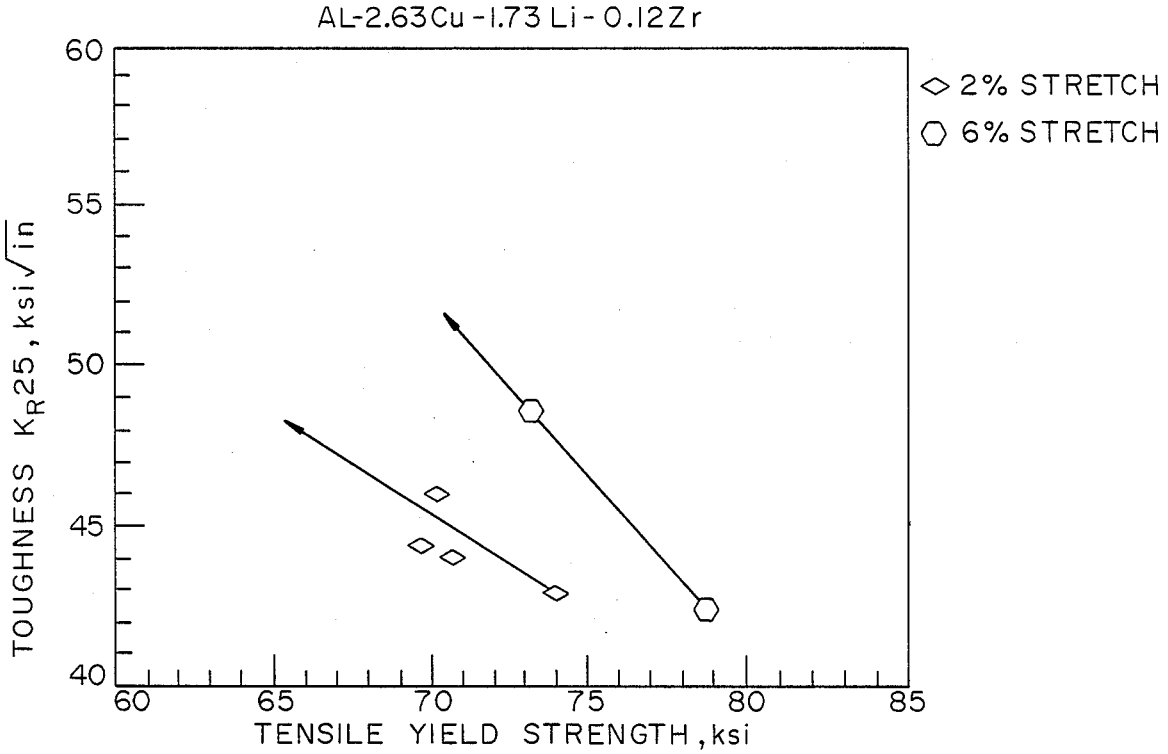
FIG. 1 shows that the relationship between toughness and yield strength for a worked alloy product in accordance with the present invention is increased by stretching.

The alloy of the present invention can contain 0.5 to 4.0 wt. % Li, 0 to 5.0 wt. % Mg, up to 5.0 wt. % Cu, 0 to 1.0 wt. % Zr, 0 to 2.0 wt. % Mn, 0 to 7.0 wt. % Zn, 0.5 wt. % max. Fe, 0.5 wt. % max. Si, the balance aluminum and incidental impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 1.0 to 4.0 wt. % Li, 0.1 to 5.0 wt. % Cu, 0 to 5.0 wt. % Mg, 0 to 1.0 wt. % Zr, 0 to 2 wt. % Mn, the balance aluminum and impurities as specified above. A typical alloy composition would contain 2.0 to 3.0 wt. % Li, 0.5 to 4.0 wt. % Cu, 0 to 3.0 wt. % Mg, 0 to 0.2 wt. % Zr, 0 to 1.0 wt. % Mn and max. 0.1 wt. % of each of Fe and Si.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

The amount of manganese should also be closely controlled. Manganese is added to contribute to grain structure control, particularly in the final product. Manganese is also a dispersoid-forming element and is precipitated in small particle form by thermal treatments and has as one of its benefits a strengthening effect. Dispersoids such as $Al_2OCu_2Mn_3$ and $Al_{12}Mg_2Mn$ can be formed by manganese. Chromium can also be used for grain structure control but on a less preferred basis. Zirconium is the preferred material for grain structure control. The use of zinc results in increased levels of strength, particularly in combination with magnesium. However, excessive amounts of zinc can impair toughness through the formation of intermetallic phases.

Toughness or fracture toughness as used herein refers to the resistance of a body, e.g. sheet or plate, to the unstable growth of cracks or other flaws.

Figure 7:
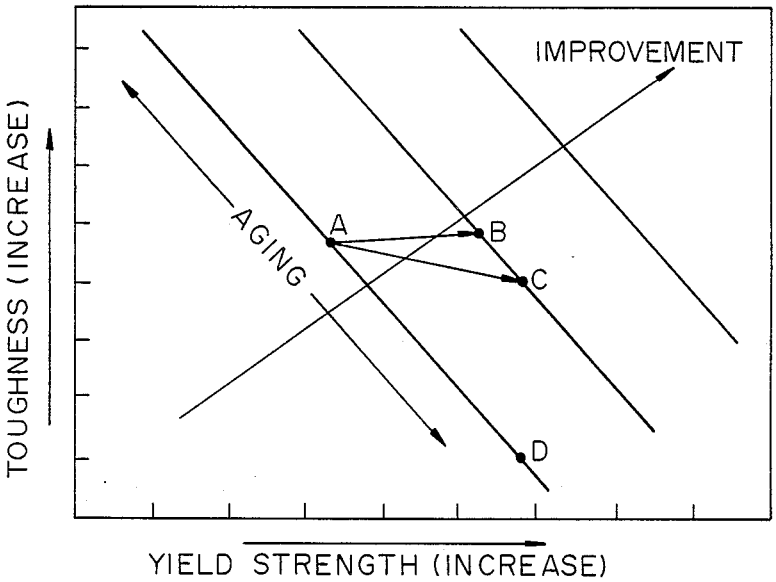
FIG. 7 illustrates different toughness yield strength relationship where shifts in the upward direction and to the right represent improved combinations of these properties.
Figure 8:
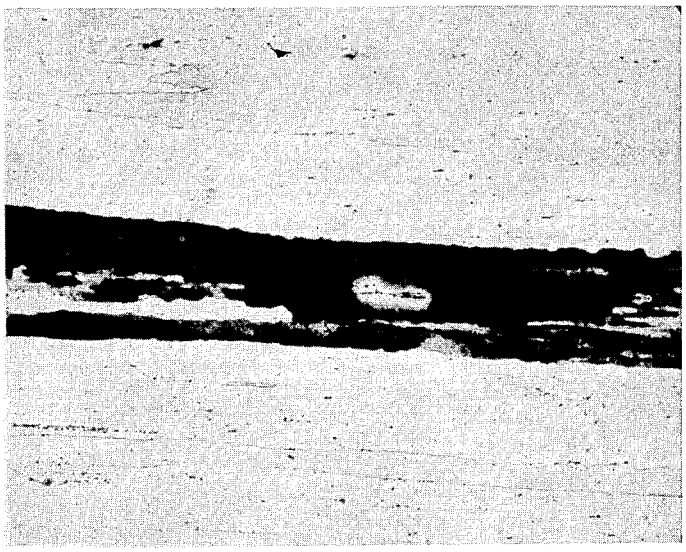
FIG. 8 shows a metallurgical structure of an aluminum-lithium alloy processed in accordance with the invention.
Figure 9:
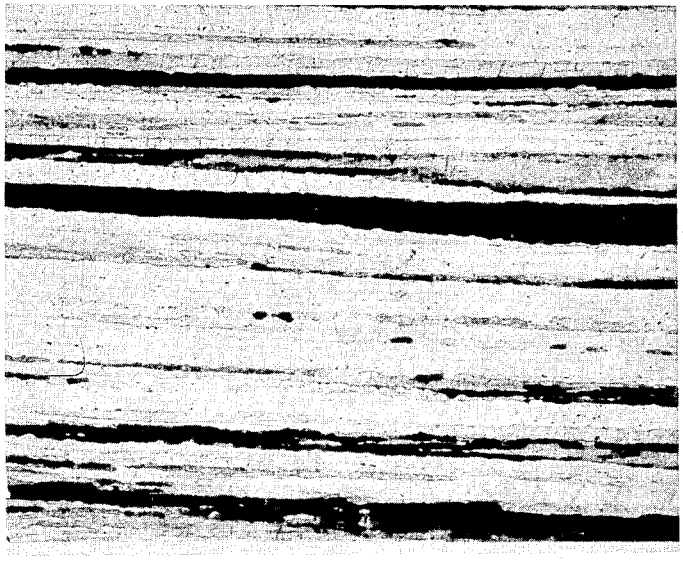
FIG. 9 shows a metallurgical structure of an aluminum-lithium alloy processed in accordance with conventional practices.

Improved combinations of strength and toughness is a shift in the normal inverse relationship between strength and toughness towards higher toughness values at given levels of strength or towards higher strength values at given levels of toughness. For example, in FIG. 7, going from point A to point D represents the loss in toughness usually associated with increasing the strength of an alloy. In contrast, going from point A to point B results in an increase in strength at the same toughness level. Thus, point B is an improved combination of strength and toughness. Also, in going from point A to point C results in an increase in strength while toughness is decreased, but the combination of strength and toughness is improved relative to point A. However, relative to point D, at point C, toughness is improved and strength remains about the same, and the combination of strength and toughness is considered to be improved. Also, taking point B relative to point D, toughness is improved and strength has decreased yet the combination of strength and toughness are again considered to be improved.

As well as providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products, with continuous casting being preferred. It should be noted that the alloy may also be provided in billet form consolidated from fine particulate such as powered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 900° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal can be rolled or extruded or otherwise subjected to working operations to produce stock such as sheet, plate or extrusions or other stock suitable for shaping into the end product.

In the present invention, it has been discovered that short transverse properties can be improved by carefully controlled thermal and mechanical operations as well as alloying of the lithium-containing aluminum base alloy. Accordingly, for purposes of improving the short transverse properties, e.g. toughness and ductility in the short transverse direction, the zirconium content of lithium-containing aluminum base alloy should be maintained in the range of 0.03 to 0.15 wt. %. Preferably, zirconium is in the range of 0.05 to 0.12 wt. %, with a typical amount being in the range of 0.08 to 0.1 wt. %. Other elements, e.g. chromium, cerium, manganese, scandium, capable of forming fine dispersoids which retard grain boundary migration and having a similar effect in the process as zirconium, may be used. The amount of these other elements may be varied, however, to produce the same effect as zirconium, the amount of any of these elements should be sufficiently low to permit recrystallization of an intermediate product, yet the amount should be high enough to retard recrystallization during solution heat treating.

For purposes of illustrating the invention, an ingot of the alloy is heated prior to an initial hot working operation. This temperture should be controlled so that a substantial amount of grain boundary precipitate, i.e., particles present at the original dendritic boundaries, not be dissolved. That is, if a higher temperature is used, most of this grain boundary precipitate would be dissolved and later operations normally would not be as effective. If the temperature is too low, then the ingot may not deform without cracking. Thus, preferably, the ingot or working stock should be heated to a temperature in the range of 600° to 950° F., and more preferably 700° to 900° F. with a typical temperature being in the range of 800° to 870° F. This step may be referred to as a low temperature preheat.

If it is desired, the ingot may be homogenized prior to this low temperature preheat without adversely affecting the end product. However, as presently understood, the preheat may be used without the prior homogenization step at no sacrifice in properties.

After the ingot has been heated to this condition, it is hot worked or hot rolled to provide an intermediate product. That is, once the ingot has reached the low temperature preheat, it is ready for the next operation. However, longer times at the preheat temperature are not detrimental. For example, the ingot may be held at the preheat temperature for up to 20 or 30 hours; but, for purposes of the present invention, times less than 1 hour, for example, may be sufficient. If the ingot were being rolled into plate as a final product, then this initial hot working can reduce the ingot to a thickness 1.5 to 15 times that of the plate. A preferred reduction is 1.5 to 5 times that of the plate with a typical reduction being two to three times the thickness of the final plate thickness. The preliminary hot working may be initiated at a temperature in the range of the low temperature preheat. However, this preliminary hot working can be carried out at a temperature in the range of 950° to 400° F. While this working step has been referred to as hot working, it may be more conveniently referred to as low temperature hot working for purposes of the present invention. Further, it should be understood that the same or similar effects may be obtained with a series or variation of temperature preheat steps and low temperature hot working steps, singly or combined, and such is contemplated within the present invention.

After this initial low temperature hot working step, the intermediate product is then heated to a temperature sufficiently high to recrystallize its grain structure. For purposes of recrystallization, the temperature can be in the range of 900° to 1040° F. or the solidus temperature. It is the recrystallization step, particularly in conjunction with the earlier steps, which permits the improvement in short transverse properties of plate, for example, fabricated in accordance with the present invention. If too much zirconium is present, then recrystallization will not occur. By the use of the word recrystallization is meant to include partial recrystallization as well as complete recrystallization.

It is believed that recrystallization, in conjunction with the low temperature preheat and the low temperature hot work, initiated at the grain boundary precipitates present at the original dendritic boundaries operate to occlude these particles, as well as segregated impurities at the dendritic boundary. Therefore, these impurities can no longer present weak sites or links for intergranular fracture. Thus, it can be seen why recrystallization should be initiated and why the control of zirconium which retards recrystallization must be controlled. That is, zirconium or its equivalent, along with the low temperature hot working conditions, determine the nature of the recrystallized texture. After recrystallization, the intermediate product is further hot worked or hot rolled to a final product shape. As noted earlier, to produce a sheet or plate-type product, the intermediate product is hot rolled to a thickness ranging from 0.1 to 0.25 inch for sheet and 0.25 to 10.0 inches for plate, for example. For this final hot working operation, the temperature should be in the range of 1000° to 750° F., and preferably initially the metal temperature should be in the range of 900° to 975° F. With respect to this last hot working step, it is important that the temperatures be carefully controlled. If too low a temperature is used, too much cold work can be transferred to the final product which can result in an adverse effect during the next thermal treatment, i.e., solution heat treating, as explained below.

In order to obtain improved short transverse properties, solution heat treating is performed as noted before, and care must be taken to ensure substantially unrecrystallized grain structure. Thus, the alloy in accordance with the invention must contain a minimum level of zirconium to retard recrystallization of the final product during solution heat treating. In addition, it is for the same reason that care must be taken during the final hot working step to guard against using too low temperatures and its attendant problems. That is, unduly high amounts of work being added in the final hot working step can result in recrystallization of the final product during solution heat treating and thus should be avoided.

Figure 11:
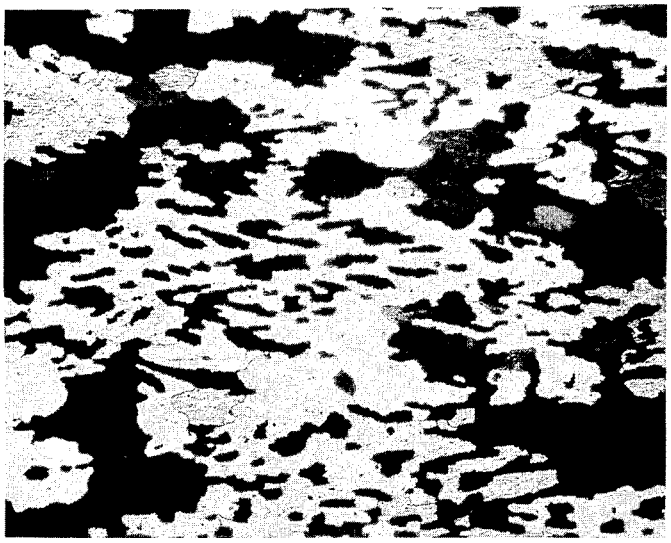
FIG. 11 shows a micrograph of a typical recrystallized structure of an intermediate product at 100x of an aluminum alloy containing 2.0 Li, 3.0 Cu and 0.11 Zr processed in accordance with the invention.

If it is required that the end product be less antisotropic or isotropic in nature, i.e., properties more or less uniform in all directions, then the low temperature hot working operation can require further control. That is, if the end product is required to be substantially free or generally lacking an intense worked texture so as to improve properties in the 45° direction, then the low temperature hot working operations can be carried out so as to attain such characteristic. For example, to improve 45° properties, a step low temperature hot working operation can be employed where the working operation and the temperature is controlled for a series of steps. Thus, in one embodiment of this operation, after the low temperature preheat, the ingot is reduced by about 5 to 35% of thickness of the original ingot in the first step of the low temperature hot working operation with preferred reductions being in the order of 10 to 25% of the thickness. The temperature for this first step should be in the range of about 665° to 925° F. In the second step of the operation, the reduction is in the order of 20 to 50% of the thickness of the material from the first step with typical reductions being about 25 to 35%. The temperature in the second step should not be greater than 700° F. and preferably is in the range of 500° to 650° F. In the third step, the reduction should be 20 to 40% of the thickness of the material from the second step, and the temperature should be in the range of 350° to 500° F. with a typical temperature being in the range of 400° to 475° F. These steps provide an intermediate product which can be recrystallized, as noted earlier, to provide a unique recrystallized intermediate structure which when hot rolled to a finished product will be substantially free of intense worked or rolled texture. A typical recrystallized structure of the intermediate product is shown in FIG. 11. For convenience of the present invention, the low temperature preheat, low temperature hot working coupled with temperature control and the recrystallization of the intermediate product are referred to herein as a recrystallization effect which, in accordance with the present invention, makes it possible to control the antistropy of the mechanical characteristics, and if desired, produce a final isotropic product. While the inventors have illustrated this embodiment of their invention by referring to a three-step process, it will be noted that the scope of their invention is not necessarily limited thereto. For example, there can be a number of low temperature hot working operations that may be employed to control antistropy depending on which property is desired, and this is now attainable as a result of the teachings herein, particularly utilizing the low temperature hot working operations and recrystallization of an intermediate product. The control can be even more effective if combined with small variations in composition of the aluminum-lithium alloys. For example, a two-step low temperature hot working operation may be employed. It is believed that in the three-step process, the last two steps of low temperature hot working are more important in producing the desired microstructure in the intermediate product. Or, the temperature direction may be reversed for each step, or combinations of low and high temperatures may be used during the low temperature hot working operations. These illustrations are not necessarily intended to limit the scope of the invention but are set forth as illustrative of the new process and aluminum-lithium products which may be attained as a result of the new processes disclosed herein.

To further provide for the desired strength and fracture toughness necessary to the final product and to the operations in forming that product, the product should be rapidly quenched to prevent or minimize uncontrolled precipitation of strengthening phases referred to herein later. Thus, it is preferred in the practice of the present invention that the quenching rate be at least 100° F. per second from solution temperature to a temperature of about 200° F. or lower. A preferred quenching rate is at least 200° F. per second in the temperature range of 900° F. or more to 200° F. or less. After the metal has reached a temperature of about 200° F., it may then be air cooled. When the alloy of the invention is slab cast or roll cast, for example, it may be possible to omit some or all of the steps referred to hereinabove, and such is contemplated within the purview of the invention.

Figure 5:
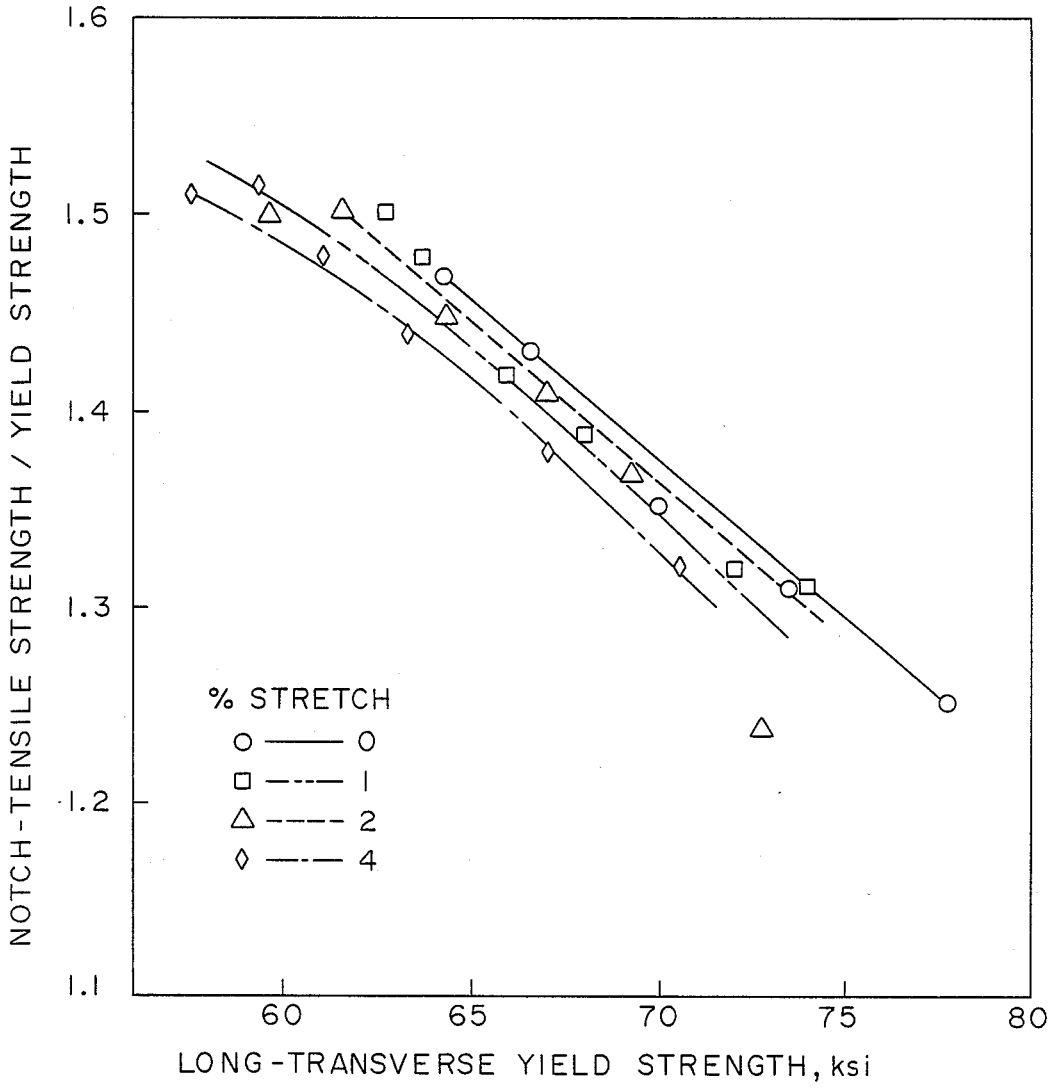
FIG. 5 shows that the relationship between toughness (notch-tensile strength divided by yield strength) and yield strength decreases with increase amounts of stretching for AA7050.
Figure 6:
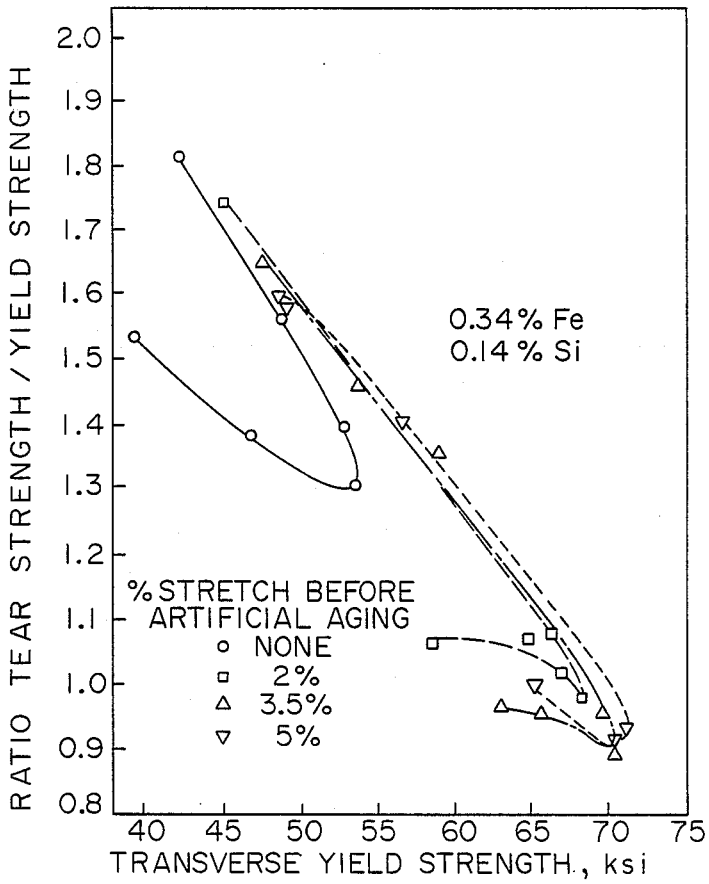
FIG. 6 shows that stretching AA2024 beyond 2% does not significantly increase the toughness-strength relationship for this alloy.

After solution heat treatment and quenching as noted herein, the improved sheet, plate or extrusion and other wrought products can have a range of yield strength from about 25 to 50 ksi and a level of fracture toughness in the range of about 50 to 150 ksi in. However, with the use of artificial aging to improve strength, fracture toughness can drop considerably. To minimize the loss in fracture toughness associated in the past with improvement in strength, it has been discovered that the solution heat treated and quenched alloy product, particularly sheet, plate or extrusion, must be stretched, preferably at room temperature, an amount greater than 3% of its original length or otherwise worked or deformed to impart to the product a working effect equivalent to stretching greater than 3% of its original length. The working effect referred to is meant to include rolling and forging as well as other working operations. It has been discovered that the strength of sheet or plate, for example, of the subject alloy can be increased substantially by stretching prior to artificial aging, and such stretching causes little or no decrease in fracture toughness. It will be appreciated that in comparable high strength alloys, stretching can produce a significant drop in fracture toughness. Stretching AA7050 reduces both toughness and strength, as shown in FIG. 5, taken from the reference by J. T. Staley, mentioned previously. Similar toughness-strength data for AA2024 are shown in FIG. 6. For AA2024, stretching 2% increases the combination of toughness and strength over that obtained without stretching; however, further stretching does not provide any substantial increases in toughness. Therefore, when considering the toughness-strength relationship, it is of little benefit to stretch AA2024 more than 2%, and it is detrimental to stretch AA7050. In contrast, when stretching or its equivalent is combined with artificial aging, an alloy product in accordance with the present invention can be obtained having significantly increased combinations of fracture toughness and strength.

While the inventors do not necessarily wish to be bound by any theory of invention, it is believed that deformation or working, such as stretching, applied after solution heat treating and quenching, results in a more uniform distribution of lithium-containing metastable precipitates after artificial aging. These metastable precipitates are believed to occur as a result of the introduction of a high density of defects (dislocations, vacancies, vacancy clusters, etc.) which can act as preferential nucleation sites for these precipitating phases (such as $T_1'$, a precursor of the $Al_2CuLi$ phase) throughout each grain. Additionally, it is believed that this practice inhibits nucleation of both metastable and equilibrium phases such $Al_3Li$, AlLi, $Al_2CuLi$ and $Al_5CuLi_3$ at grain and sub-grain boundaries. Also, it is believed that the combination of enhanced uniform precipitation throughout each grain and decreased grain boundary precipitation results in the observed higher combination of strength and fracture toughness in aluminum-lithium alloys worked or deformed as by stretching, for example, prior to final aging.

In the case of sheet or plate, for example, it is preferred that stretching or equivalent working is greater than 3% and less than 14%. Further, it is preferred that stretching be in the range of about a 4 to 12% increase over the original length with typical increases being in the range of 5 to 8%.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 95 ksi. However, the useful strengths are in the range of 50 to 85 ksi and corresponding fracture toughnesses are in the range of 25 to 75 ksi in. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments well known in the art, including natural aging. However, it is presently believed that natural aging provides the least benefit. Also, while reference has been made herein to single aging steps, multiple aging steps, such as two or three aging steps, are contemplated and stretching or its equivalent working may be used prior to or even after part of such multiple aging steps.

The following examples are further illustrative of the invention.

EXAMPLE I

An aluminum alloy consisting of 1.73 wt. % Li, 2.63 wt. % Cu, 0.12 wt. % Zr, the balance essentially aluminum and impurities, was cast into an ingot suitable for rolling. The ingot was homogenized in a furnace at a temperature of 1000° F. for 24 hours and then hot rolled into a plate product about one inch thick. The plate was then solution heat treated in a heat treating furnace at a temperature of 1025° F. for one hour and then quenched by immersion in 70° F. water, the temperature of the plate immediately before immersion being 1025° F. Thereafter, a sample of the plate was stretched 2% greater than its original length, and a second sample was stretched 6% greater than its original length, both at about room temperature. For purposes of artificially aging, the stretched samples were treated at either 325° F. or 375° F. for times as shown in Table I. The yield strength values for the samples referred to are based on specimens taken in the longitudinal direction, the direction parallel to the direction of rolling. Toughness was determined by ASTM Standard Practice E561-81 for R-curve determination. The results of these tests are set forth in Table I. In addition, the results are shown in FIG. 1 where toughness is plotted against yield strength. It will be noted from FIG. 1 that 6% stretch displaces the strength-toughness relationship upwards and to the right relative to the 2% stretch. Thus, it will be seen that stretching beyond 2% substantially improved toughness and strength in this lithium containing alloy. In contrast, stretching decreases both strength and toughness in the long transverse direction for alloy 7050 (FIG. 5). Also, in FIG. 6, stretching beyond 2% provides added little benefit to the toughness-strength relationship in AA2024.

TABLE I

| | | 2% Stretch | | 6% Stretch | |
|---|---|---|---|---|---|
| Aging hrs. | Practice °F. | Tensile Yield Strength, ksi | $K_R25$, ksi in. | Tensile Yield Strength, ksi | $K_R25$, ksi in. |
| 16 | 325 | 70.2 | 46.1 | 78.8 | 42.5 |
| 72 | 325 | 74.0 | 43.1 | — | — |
| 4 | 375 | 69.6 | 44.5 | 73.2 | 48.7 |
| 16 | 375 | 70.7 | 44.1 | — | — |

EXAMPLE II

Figure 2:
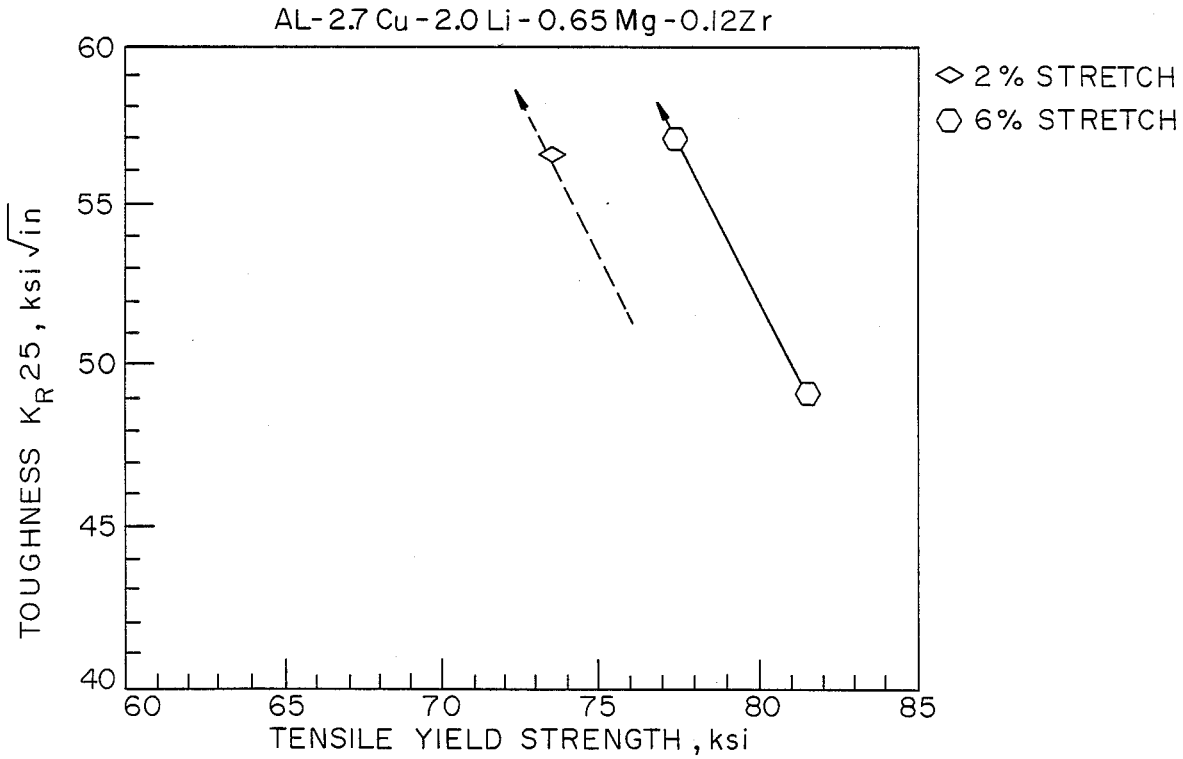
FIG. 2 shows that the relationship between toughness and yield strength is increased for a second worked alloy product stretched in accordance with the present invention.
Figure 3:
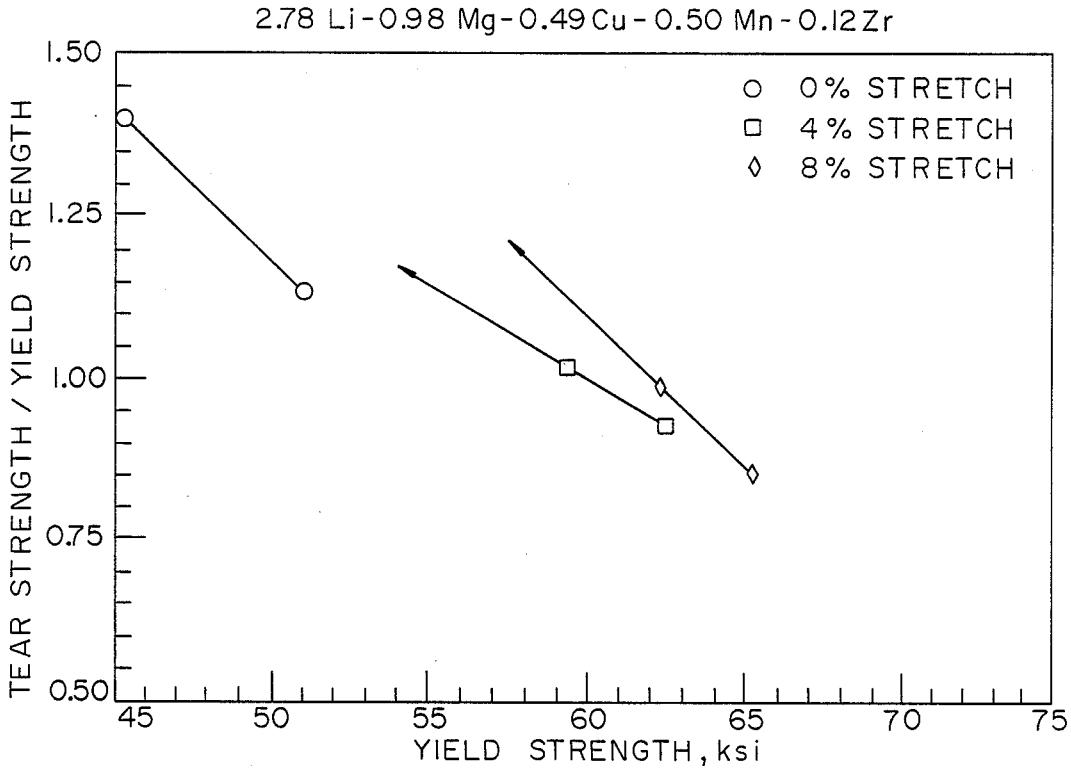
FIG. 3 shows the relationship between toughness and yield strength of a third alloy product stretched in accordance with the present invention.

An aluminum alloy consisting of, by weight, 2.0% Li, 2.7% Cu, 0.65% Mg and 0.12% Zr, the balance essentially aluminum and impurities, was cast into an ingot suitable for rolling. The ingot was homogenized at 980° F. for 36 hours, hot rolled to 1.0 inch plate as in Example I, and solution heat treated for one hour of 980° F. Additionally, the specimens were also quenched, stretched, aged and tested for toughness and strength as in Example I. The results are provided in Table II, and the relationship between toughness and yield strength is set forth in FIG. 2. As in Example I, stretching this alloy 6% displaces the toughness-strength relationship to substantially higher levels. The dashed line through the single data point for 2% stretch is meant to suggest the probable relationship for this amount of stretch.

TABLE II

| Aging hrs. | Practice °F. | 2% Stretch Tensile Yield Strength, ksi | 2% Stretch $K_R25$, ksi in. | 6% Stretch Tensile Yield Strength, ksi | 6% Stretch $K_R25$, ksi in. |
|---|---|---|---|---|---|
| 48 | 325 | — | — | 81.5 | 49.3 |
| 72 | 325 | 73.5 | 56.6 | — | — |
| 4 | 375 | — | — | 77.5 | 57.1 |

EXAMPLE III

An aluminum alloy consisting of, by weight, 2.78% Li, 0.49% Cu, 0.98% Mg, 0.50 Mn and 0.12% Zr, the balance essentially aluminum, was cast into an ingot suitable for rolling. The ingot was homogenized as in Example I and hot rolled to plate of 0.25 inch thick. Thereafter, the plate was solution heat treated for one hour at 1000° F. and quenched in 70° water. Samples of the quenched plate was stretched 0%, 4% and 8% before aging for 24 hours at 325° F. or 375° F. Yield strength was determined as in Example I and toughness was determined by Kahn type tear tests. This test procedure is described in a paper entitled "Tear Resistance of Aluminum Alloy Sheet as Determined from Kahn-Type Tear Tests", *Materials Research and Standards*, Vol. 4, No. 4, 1984 April, p. 181. The results are set forth in Table III, and the relationship between toughness and yield strength is plotted in FIG. 5.

Here, it can be seen that stretching 8% provides increased strength and toughness over that already gained by stretching 4%. In contrast, data for AA2024 stretched from 2% to 5% (FIG. 6) fall in a very narrow band, unlike the larger effect of stretching on the toughness-strength relationship seen in lithium-containing alloys.

TABLE III

| Stretch | Aging Practice hrs. | Aging Practice °F. | Tensile Yield Strength ksi | Tear Strength ksi | Tear Strength/ Yield Strength |
|---|---|---|---|---|---|
| 0% | 24 | 325 | 45.6 | 63.7 | 1.40 |
| 4% | 24 | 325 | 59.5 | 60.5 | 1.02 |
| 8% | 24 | 325 | 62.5 | 61.6 | 0.98 |
| 0% | 24 | 375 | 51.2 | 58.0 | 1.13 |
| 4% | 24 | 375 | 62.6 | 58.0 | 0.93 |
| 8% | 24 | 375 | 65.3 | 55.7 | 0.85 |

EXAMPLE IV

Figure 4:
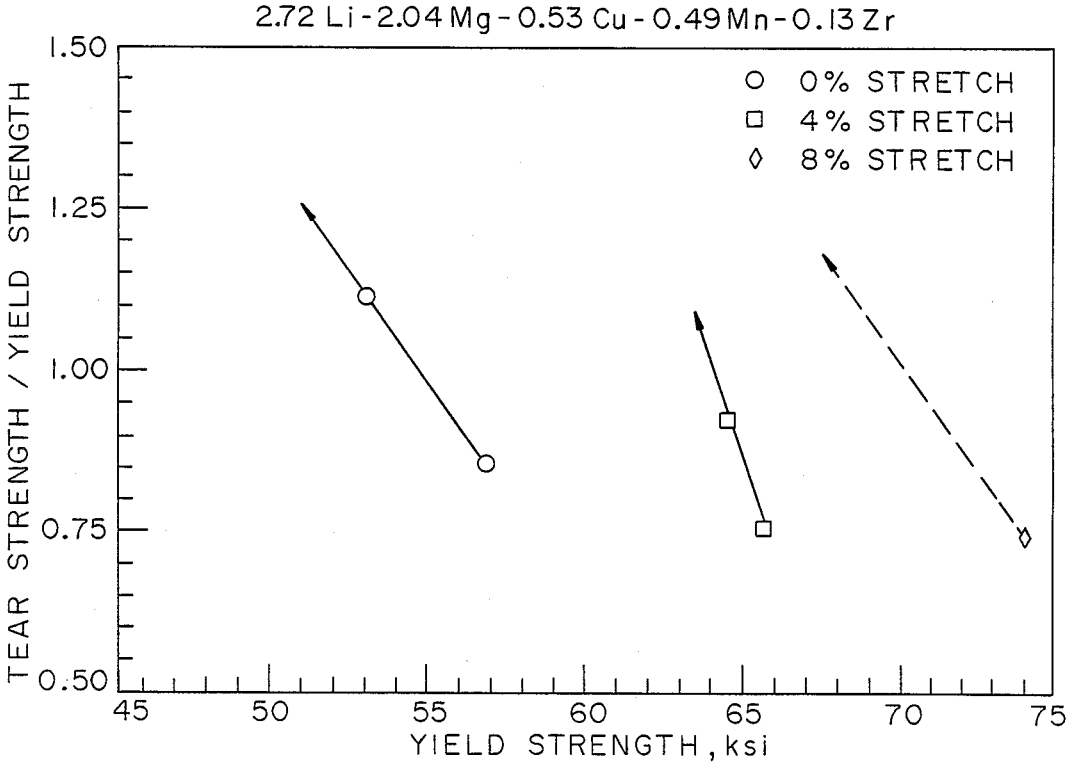
FIG. 4 shows that the relationship between toughness and yield strength is increased for another alloy product stretched in accordance with the present invention.

An aluminum alloy consisting of, by weight, 2.72% Li, 2.04% Mg, 0.53% Cu, 0.49 Mn and 0.13% Zr, the balance essentially aluminum and impurities, was cast into an ingot suitable for rolling. Thereafter, it was homogenized as in Example I and then hot rolled into plate 0.25 inch thick. After hot rolling, the plate was solution heat treated for one hour at 1000° F. and quenched in 70° water. Samples were taken at 0%, 4% and 8% stretch and aged as in Example I. Tests were performed as in Example III, and the results are presented in Table IV. FIG. 4 shows the relationship of toughness and yield strength for this alloy as a function of the amount of stretching. The dashed line is meant to suggest the toughness-strength relationship for this amount of stretch. For this alloy, the increase in strength at equivalent toughness is significantly greater than the previous alloys and was unexpected in view of the behavior of conventional alloys such as AA7050 and AA2024.

TABLE IV

| Stretch | Aging Practice hrs. | Aging Practice °F. | Tensile Yield Strength ksi | Tear Strength ksi | Tear Strength/ Yield Strength |
|---|---|---|---|---|---|
| 0% | 24 | 325 | 53.2 | 59.1 | 1.11 |
| 4% | 24 | 325 | 64.6 | 59.4 | 0.92 |
| 8% | 24 | 325 | 74.0 | 54.2 | 0.73 |
| 0% | 24 | 375 | 56.9 | 48.4 | 0.85 |
| 4% | 24 | 375 | 65.7 | 49.2 | 0.75 |

EXAMPLE V

An aluminum alloy consisting of, by weight, 2.25% Li, 2.98% Cu, 0.12% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in a furnace for 30 minutes at 975° F. and hot rolled to 1.75 inch thick plate. The plate was solution heat treated for 2 hours at 1020° F. followed by a continuous water spray quench with a water temperature of 72° F. The plate was stretched at room temperature in the rolling direction with 4.9% permanent set. Stretching was followed by an artificial aging treatment of 18 hours at 325° F. Tensile properties were determined in the short transverse direction in accordance with ASTM B-557. These values are shown in Table V. The ultimate tensile strength and the yield tensile strength were equal, and the resulting elongations are zero. The results of properties in the longitudinal, long transverse and 45° directions are shown in Table V*a*.

TABLE V

| Specimen No. | Short Transverse Properties: Tensile Ultimate Strength (ksi) | Short Transverse Properties: Tensile Yield Strength (ksi) | Percent Elongation (%) |
|---|---|---|---|
| 1 | 51.5 | 51.5 | 0 |
| 2 | 47.3 | 47.3 | 0 |
| 3 | 55.0 | 55.0 | 0 |

TABLE Va

| Test Direction | Test Plane | Tensile Ultimate Strength (ksi) | Tensile Yield Strength (ksi) | Percent Elongation (%) |
|---|---|---|---|---|
| Longitudinal | T/4 | 76.5 | 70.6 | 13.0 |
| Long Trans. | T/4 | 78.8 | 71.4 | 3.5 |
| 45 Degree | T/4 | 76.5 | 66.7 | 8.0 |
| Longitudinal | T/2 | 80.9 | 75.4 | 6.5 |
| Long Trans. | T/2 | 79.2 | 72.5 | 4.5 |

EXAMPLE VI

An aluminum alloy consisting of, by weight, 2.11% Li, 2.75% Cu, 0.09% Zr, the balance being essentially aluminum and impurities, was cast into an ingot suitable for rolling. The ingot was homogenized in a furnace at a temperature of 1000° F. for 24 hours and air cooled. The ingot was then preheated in a furnace for 30 minutes at 975° F. and hot rolled to 1.75 inch thick plate. The plate was solution heat treated for 1.5 hours at 1000° F. and then quenched with a continuous water spray (72° F). The plate was stretched at room temperature in the rolling direction with 6.3% permanent set. Stretching was followed by an artificial aging treatment of 8 hours at 300° F. Tensile properties were determined in the short transverse direction in accordance with ASTM B-557. These values are shown in Table VI. The ultimate tensile strength and the yield strength were equal, and the resulting elongations are zero. The longitudinal and long transverse properties are shown in Table VI*a*.

TABLE VI

| Short Transverse Properties | | | |
|---|---|---|---|
| Specimen No. | Tensile Ultimate Strength (ksi) | Tensile Yield Strength (ksi) | Percent Elongation (%) |
| 1 | 32.1 | 32.1 | 0 |
| 2 | 36.3 | 36.3 | 0 |

TABLE VIa

| Test Direction | Test Plane | Tensile Ultimate Strength (ksi) | Tensile Yield Strength (ksi) | Percent Elongation (%) |
|---|---|---|---|---|
| Longitudinal | T/4 | 63.9 | 56.5 | 10.0 |
| Long Trans. | T/4 | 62.6 | 49.2 | 10.0 |

EXAMPLE VII

An aluminum alloy consisting of, by weight, 2.0% Li, 2.55% Cu, 0.09% Zr, the balance being essentially aluminum and impurities, was cast into an ingot suitable for rolling. The ingot was homogenized in a furnace at a temperature of 950° F. for 8 hours followed immediately by a temperature of 1000° F. for 24 hours and air cooled. The ingot was then preheated in furnace for 6 hours at 875° F. and hot rolled to a 3.5 inch thick slab. The slab was returned to a furnace for reheating at 1000° F. for 11 hours and then finish hot rolled to 1.75 inch thick plate. The plate was solution heat treated for 2 hours at 1020° F. and continuously water spray quenched with water at 72° F. The plate was stretched at room temperature in the longitudinal direction with 5.9% permanent set. Stretching was following by an artificial aging treatment of 36 hours at 325° F. Short transverse tensile properties were determined in accordance with ASTM B-557 and are shown in Table VII. In addition to these tests, samples were cut after stretching and aged in the laboratory at 300 and 325° F. for various times. This data is shown in Table VIII. Regardless of the strength of the material fabricated with the standard or conventional process, the resulting elongations are zero. Material fabricated using the new process shows a clear increase in elongation. The properties in the longitudinal, long transverse and 45° direction are shown in Table VIII*a*.

TABLE VII

| Short Transverse Properties | | | |
|---|---|---|---|
| Specimen No. | Tensile Ultimate Strength (ksi) | Tensile Yield Strength (ksi) | Percent Elongation (%) |
| 1 | 66.1 | 61.3 | 4.6 |
| 2 | 68.9 | 61.3 | 2.6 |
| 3 | 64.7 | 61.4 | 1.4 |

TABLE VIII

| Short Transverse Properties | | | | | |
|---|---|---|---|---|---|
| Specimen No. | Aging Temp. (°F.) | Aging Time (hrs) | Ultimate Strength (ksi) | Tensile Yield Strength (ksi) | Tensile Percent Elongation |
| 1 | 300 | 8 | 57.5 | 42.5 | 9.5 |
| 2 | 300 | 16 | 63.6 | 52.1 | 5.7 |
| 3 | 300 | 24 | 65.1 | 53.9 | 3.5 |
| 4 | 325 | 18 | 68.9 | 59.8 | 2.4 |
| 5 | 325 | 24 | 67.1 | 67.1 | 2.2 |
| 6 | 325 | 36 | 67.0 | 67.0 | 1.4 |

EXAMPLE VIII

Figure 10:
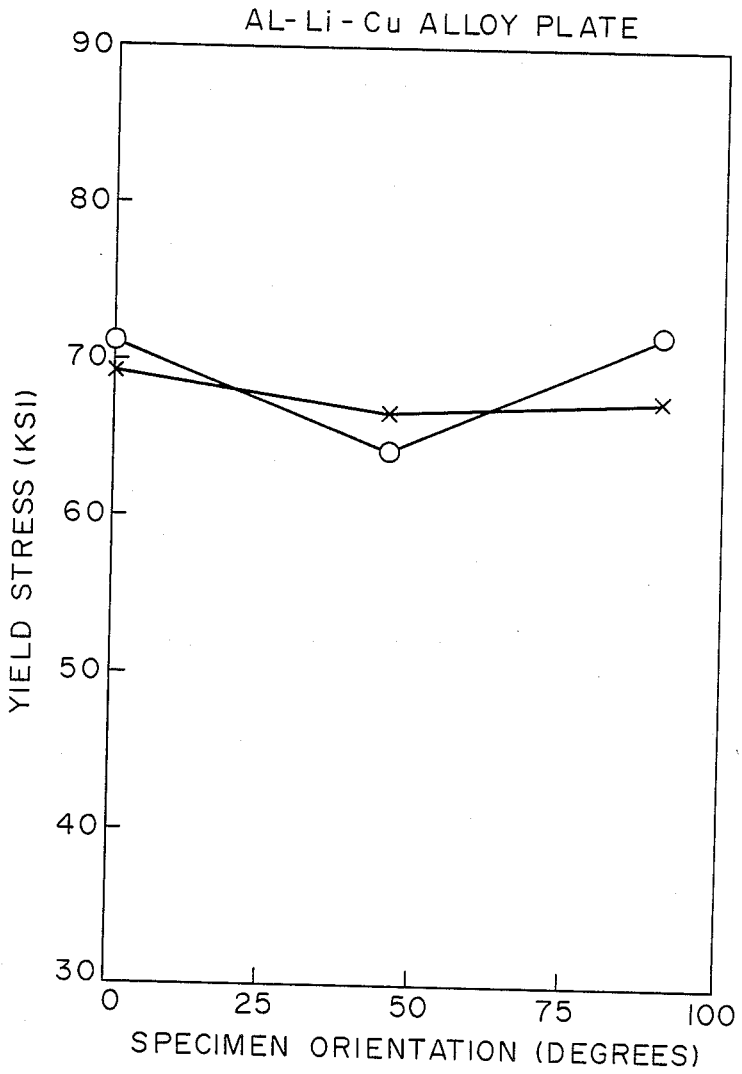
FIG. 10 shows a graph of yield stress plotted against the orientation of the specimen.
Figure 12:
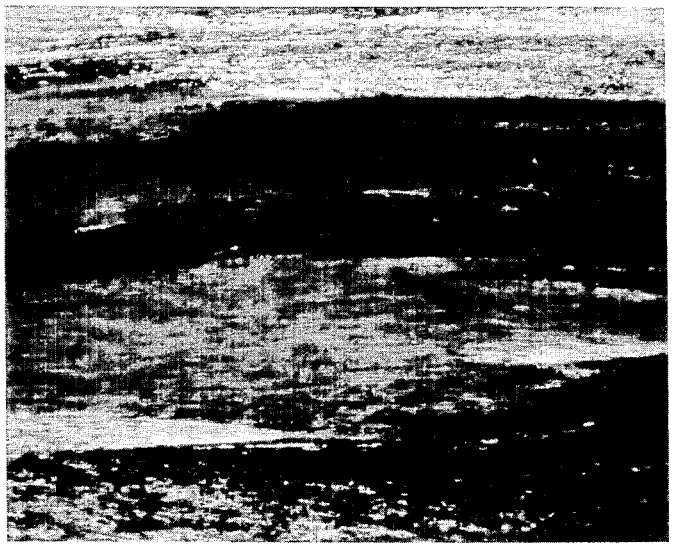
FIG. 12 shows a micrograph taken in the longitudinal direction of a final product at 50x having isotropic properties.

An aluminum alloy consisting of, by weight, 2.92% Cu, 1.80% Li, 0.11% Zr, the balance being essentially aluminum and impurities, was cast into an ingot suitable for rolling. The ingot was homogenized in a furnace at a temperature of 950° F. for 8 hours followed by a temperature of 1000° F. for 24 hours and air cooled. The ingot was then preheated in furnace for 0.5 hours at 70° F. and received three steps of hot rolling: (1) 15% reduction by hot rolling at 750° F., then air cooled to 600° F.; (2) 45% reduction by hot rolling at 600° F., then air cooled to 450° F.; (3) 30% reduction by hot rolling at 450° F. to fabricate 1.0 inch gauge intermediate product. This intermediate slab was then subjected to a recrystallization treatment at a temperature of 1020° F. for 2 hours. There after, the intermediate slabl was hot rolled to 0.5 inch gauge plate starting at a temperature of 800°. The final gauge plate was solution heat treated for 2 hours at a metal temperature of 1020° F. and immediately quenched in 70° F. water and stretched by 8%. For artificial aging, the quenched and stretched plate was aged at 325° F. for 24 hours. FIG. 10 is an optical micrograph of the plate taken at the T/2 area showing unrecrystallized microstructure without sharply defined grain boundaries of thin elongated grain structure which is commonly observed in conventionally fabricated plate product, sometimes referred to as fibering. Texture analysis of plate showed a lack of strong as-rolled texture components normally found in conventionally processed material. Tensile test results are shown in Table IX. To illustrate the benefit of the process, the tensile test results are plotted in FIG. 12 comparing yield stress anistropy of this plate to the plate from Example VII.

TABLE IX

| Tensile Test Result From S.No. 5047188CC-BB | | | | |
|---|---|---|---|---|
| Test Direction | Test Plane | Ultimate (ksi) | Yield (ksi) | Percent Elongation (%) |
| Longitudinal | T/2 | 69.2 | 73.3 | 7.0 |
| Long Trans. | T/2 | 67.7 | 72.9 | 6.5 |
| 45 Degree | T/2 | 66.8 | 72.2 | 7.5 |

While the invention has been described in terms of preferred embodiments, the claims appended hereto are intended to encompass other embodiments which fall within the spirit of the invention.

What is claimed is:

1. A method of making lithium containing aluminum base alloy products having improved properties in the short transverse direction, the method comprising the steps of:

(a) providing a body of an aluminum base alloy consisting essentially of 0.5 to 4.0 wt. % Li, 0 to 5.0 wt.

% Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities;

(b) heating the body to a temperature for initial hot working to put said body in a condition for recrystallization;

(c) hot working the heated body to provide an intermediate product;

(d) recrystallizing said intermediate product;

(e) hot working the recrystallized product to a shaped product; and (f) solution heat treating, quenching and aging said shaped product to provide a non-recrystallized product having improved levels of short transverse properties.

2. The method in accordance with claim 1 wherein in step (b) thereof the heating is carried out at a temperature in the range of 600° to 900° F.

3. The method in accordance with claim 1 wherein in step (b) thereof the heating is carried out at a temperature in the range of 700° to 900° F.

4. The method in accordance with claim 1 wherein in step (b) thereof the heating is carried out at a temperature in the range of 800° to 870° F.

5. The method in accordance with claim 1 wherein the hot working of the heated body is carried out at a temperature in the range of 400° to 975° F.

6. The method in accordance with claim 1 wherein the hot working of the heated body is carried out at a temperature in the range of 700° to 870° F.

7. The method in accordance with claim 1 wherein the recrystallization step is carried out at a temperature in the range of 900° to 1040° F.

8. The method in accordance with claim 1 wherein the recrystallization step is carried out at a temperature in the range of 980° to 1020° F.

9. The method in accordance with claim 1, step (e) thereof, wherein the hot working of the recrystallized product is carried out at a temperature in the range of 700° to 1040° F. at the start of the hot working operation.

10. The method in accordance with claim 1, step (e) thereof, wherein the hot working of the recrystallized product is carried out at a temperature in the range of 750° to 950° F. at the start of the hot working operation.

11. The method in accordance with claim 1, step (e) thereof, wherein the hot working of the recrystallized product is carried out at a temperature in the range of 350° to 850° F. at the finish of the hot working operation.

12. The method in accordance with claim 1, step (e) thereof, wherein the hot working of the recrystallized product is carried out at a temperature in the range of 350° to 850° F. at the finish of the hot working operation.

13. The method in accordance with claim 1 wherein the solution heat treating is carried out at a temperature in the range of 900° to 1050° F.

14. The method in accordance with claim 1 wherein the quench is a cold water quench.

15. The method in accordance with claim 1 wherein after solution heat treating and quenching, the shaped product is artificially aged at a temperature in the range of 150° to 400° F.

16. The method in accordance with claim 1 wherein the product is a flat rolled product.

17. The method in accordance with claim 16 wherein the body is hot rolled to provide a flat rolled product having a thickness of 1.5 to 15 times the final product.

18. The method in accordance with claim 1 including imparting to said product prior to an aging step a working effect equivalent to stretching said product at room temperature in order that, after an aging step, said product can have improved combinations of strength and fracture toughness.

19. The method in accordance with claim 18 wherein said working effect equivalent to stretching the wrought product an amount greater than 3% of its original length at room temperature.

20. The method in accordance with claim 19 wherein said working effect equivalent to stretching the wrought product 4 to 10% of its original length at room temperature.

21. The method in accordance with claim 18 wherein said working effect is stretching the wrought product 3 to 10% of its original length at room temperature.

22. The method in accordance with claim 21 wherein said working effect is stretching the wrought product 4 to 10% of its original length at room temperature.

23. The method in accordance with claim 1 wherein the body is subjected to a homogenization treatment prior to heating in step (b).

24. A method of making lithium containing aluminum base alloy products having improved properties in the short transverse direction, the method comprising the steps of:

(a) providing a body of an aluminum base alloy consisting essentially of 0.5 to 4.0 wt. % Li, 0 to 5.0 wt. % Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities;

(b) heating the body to a temperature in the range of 700° to 900° F. for initial hot working to put said body in a condition for recrystallization;

(c) hot working the heated body to a temperature in the range of 400° to 900° F. to provide an intermediate flat rolled product having a thickness 1.5 to 15 that of a final product;

(d) recrystallizing said intermediate product at a temperature in the range of 900° to 1040° F.;

(e) hot working the recrystallized product to a final thickness product, said hot working of the recrystallized product starting at a temperature in the range of 750° to 950° F.; and (f) solution heat treating the final product at a temperature in the range of 900° to 1050° F., quenching and aging said shaped product to provide a non-recrystallized final product having improved levels of short transverse properties.

25. A method of making lithium containing aluminum base alloy products having improved properties in the short transverse direction, the method comprising the steps of:

(a) providing a body of an aluminum base alloy consisting essentially of 0.5 to 4.0 wt. % Li, 0 to 5.0 wt. % Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities;

(b) heating the body to a temperature in the range of 700° to 900° F. for initial hot working to put said body in a condition for recrystallization;
(c) hot working the heated body to a temperature in the range of 400° to 900° F. to provide an intermediate flat rolled product having a thickness 1.5 to 15 that of a final product;
(d) recrystallizing said intermediate product at a temperature in the range of 900° to 1040° F.;
(e) hot working the recrystallized product to a final thickness product, said hot working of the recrystallized product starting at a temperature in the range of 700° to 1040° F.; and
(f) solution heat treating and quenching the final product;
(g) imparting to said product prior to an aging step a working effect equivalent to stretching said product at room temperature; and
(h) aging said shaped product to provide a non-recrystallized final product having improved levels of short transverse properties.

26. The method in accordance with claim 25 wherein said working effect is equivalent to stretching the wrought product an amount greater than about 4% of its original length at room temperature.

27. The method in accordance with claim 25 wherein said working effect is stretching the wrought product 4 to 10% of its original length at room temperature.

28. A method of making lithium containing aluminum base alloy products having improved properties in the short transverse direction, the method comprising the steps of:
(a) providing a body of an aluminum base alloy consisting essentially of 0.5 to 4.0 wt. % Li, 0 to 5.0 wt. % Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities;
(b) heating the body to a temperature for initial hot working but at a temperature sufficiently low such that a substantial amount of grain boundary precipitate is not dissolved in order to provide nucleation sites for subsequent recrystallization;
(c) hot working the heated body to provide an intermediate product;
(d) recrystallizing said intermediate product;
(e) hot working the recrystallized product to a final shaped product; and
(f) solution heat treating, quenching and aging said shaped product to provide a non-recrystallized final product having improved levels of short transverse properties.

29. The method in accordance with claim 1 wherein the non-recrystallized final product has an elongation in the range of 2 to 10% in the short transverse direction.

30. A method of making lithium containing aluminum base alloy products having improved properties in the short transverse direction, the method comprising the steps of:
(a) providing a body of an aluminum base alloy consisting essentially of 0.5 to 4.0 wt. % Li, 0 to 5.0 wt. % Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities;
(b) heating the body to a low temperature preheat for initial low temperature hot working to put said body in a condition for recrystallization;
(c) low temperature hot working the heated body to provide an intermediate product;
(d) recrystallizing said intermediate product;
(e) hot working the recrystallized product to a final shaped product; and
(f) solution heat treating, quenching and aging said shaped product to provide a non-recrystallized final product having improved levels of short transverse properties.

31. An unrecrystallized aluminum base alloy wrought product suitable for aging and having the ability to develop improved combinations of strength and fracture toughness in the short transverse direction in response to an aging treatment, the product consisting essentially of 0.5 to 4.0 wt. % Li, 0 to 5.0 wt. % Mg, up to 5.0 wt. % Cu, 0 to 2.0 wt. % Mn, 0 to 7.0 wt. % Zn, 0.5 wt. % max. Fe, 0.5 wt. % max. Si, and one of the elements selected from the group consisting of Zr, Cr, Ce and Sc, the balance aluminum and incidental elements and impurities, the product having imparted thereto a recrystallization effect prior to hot working and solution heat treating to provide an unrecrystallized product having improved properties in the short transverse direction.

32. The product in accordance with claim 31 wherein in the short transverse direction the product has an elongation in the range of 1 to 10%.

33. The product in accordance with claim 31 wherein the product has imparted thereto prior to an aging step a working effect equivalent to stretching an amount greater than about 3% at room temperature in order that after an aging step, the product has improved properties in the short transverse direction.

34. The product in accordance with claim 31 wherein Li is in the range of 1.0 to 4.0 wt. % and Zr in the range of 0.03 to 0.15 wt. %.

35. The product in accordance with claim 31 wherein Cu is in the range of 1.0 to 5.0 wt. %.

36. The product in accordance with claim 31 wherein Li is in the range of 2.0 to 3.0 wt. %, Cu is in the range of 0.5 to 4.0 wt. %, Mg is in the range of 0 to 3.0 wt. %, Zr is in the range of 0.05 to 0.12 wt. % and Mn is in the range of 0 to 1.0 wt. %.

37. The product in accordance with claim 31 wherein the wrought product is flat rolled product.

38. An unrecrystallized aluminum base alloy wrought product having improved short transverse properties, the product comprising Li in the range of 2.0 to 3.0 wt. %, Cu in the range of 0.5 to 4.0 wt. %, Mg in the range of 0 to 3.0 wt. %, Zr in the range of 0.05 to 0.12 wt. % and Mn in the range of 0 to 1.0 wt. %, the product having imparted thereto a recrystallization effect prior to hot working and solution heat treating to provide an un-recrystallized product and having imparted thereto prior to an aging step a working effect equivalent to stretching a amount greater than about 3% at room temperature in order that after an aging step, the product having an elongation in the short transverse direction in the range of 2 to 10%.

* * * * *